United States Patent [19]

Kamohara

[11] Patent Number: 4,686,420

[45] Date of Patent: Aug. 11, 1987

[54] ELECTRON GUN

[75] Inventor: Eiji Kamohara, Fukaya, Japan

[73] Assignee: Kabushiki Kaisha Toshiba, Kawasaki, Japan

[21] Appl. No.: 756,299

[22] Filed: Jul. 18, 1985

[30] Foreign Application Priority Data

Jul. 26, 1984 [JP] Japan ..... 59-154008

[51] Int. Cl.[4] ..... H01J 29/46; H01J 29/56

[52] U.S. Cl. ..... 315/15; 313/414; 313/449

[58] Field of Search ..... 315/14, 15, 16; 313/414, 449

[56] References Cited

U.S. PATENT DOCUMENTS

| | | | |
|---|---|---|---|
| 3,501,668 | 3/1970 | Pappadis | 315/16 |
| 3,678,329 | 7/1972 | Miyaoka | 315/30 |
| 3,932,786 | 1/1976 | Campbell | 313/414 |
| 4,124,810 | 11/1978 | Bortfeld et al. | 313/414 |
| 4,400,649 | 8/1983 | Chen | 313/449 |

FOREIGN PATENT DOCUMENTS 0152933 8/1985 European Pat. Off. .

2086649A 5/1982 United Kingdom .

*Primary Examiner*—Theodore M. Blum

*Attorney, Agent, or Firm*—Cushman, Darby & Cushman

[57] ABSTRACT

An electron gun for producing and directing at least one electron beam along a beam path comprises a beam forming section and a main lens section for focusing the electron beam. The main lens section includes first and second electrodes arranged along the beam path and each having an aperture through which the electron beam is passed, and an auxiliary electrode located between the first and second electrodes and having an aperture through which the electron beam is passed. The aperture of the auxiliary electrode is wider than those of the first and second electrodes. Different voltages are applied to the first and second electrodes, and the auxiliary voltage between the voltages is applied to the auxiliary electrode. An electrostatic field formed between the first and second electrodes is corrected by placing a correcting electrode within the bathtub-shaped auxiliary electrode which is responsive to the auxiliary voltage such that the electron beams are more effectively converged.

5 Claims, 10 Drawing Figures

ELECTRON GUN

BACKGROUND OF THE INVENTION

The present invention relates to an electron gun for a cathode-ray tube, and more specifically to an electron lens of an electron gun assembly for focusing at least one electron beam, preferably two or more electron beams.

Conventionally, a cathode-ray tube includes at least one electron gun. The electron gun comprises a beam forming section for producing an electron beam and a main lens section for focusing the electron beam on the target. The spot diameter of the electron beam on the target is a very important factor to determine the performance of the cathode-ray tube. The spot diameter on the target should preferably be minimized, depending on the performance of the electron gun. Improvement of the performance of the main lens section is an effective measure for improving the performance of the electron gun as a whole.

The main lens section is chiefly composed of an electrostatic electron lens. In the electron lens region, electrodes, each having an aperture, are coaxially arranged so as to be applied with predetermined voltages. There may be several types of such electrostatic electron lenses which vary according to the variety of voltages. For higher performance of the main lens section, however, it is necessary to increase the size of the aperture, thereby increasing the lens aperture in the optical sense, or to lengthen the separation distance of the electrodes to cause a gradual potential change in the region around the electrodes, thereby forming a long-focus lens having a long focal length.

However, such a prior art electron gun for a cathode-ray tube is sealed in a cylindrical glass tube, i.e., the neck portion of a cathode-ray tube. Therefore, the size of the aperture of the electrodes (or the lens diameter) is restricted by the diameter of the cylindrical glass tube. Also, the separation distance of the electrodes is limited so that an electrostatic focusing field formed between the electrodes may not be influenced by any other undesired electric fields in the cylindrical glass tube. In a color picture tube, in particular, if a plurality of electron guns are arranged in line, narrower intervals between the electron guns will make it easier to converge a plurality of electron beams on the same point on the whole surface of a screen. In consideration of deflection, moreover, the narrow intervals between the electron guns improve the economy of electric power. The narrower intervals, however, require a further reduction in the size of the apertures of the electrodes.

In the cathode-ray tube as described above, the lens performance is expected to be improved by the use of a long-focus lens which can produce, without an extension of the separation distance of the electrodes, an effect equivalent to that obtained with use of a longer separation distance. There are proposed several electrostatic electron lenses for such a cathode-ray tube. Among these lenses, for example, there is a "tripotential" and a "single-element bipotential lens" disclosed in U.S. Pat. No. 4,124,810 by Bortfeld et al.

In the single-element bipotential lens disclosed in U.S. Pat. No. 4,124,810, three cylindrical electrodes with the same diameter are arranged along electron beams for low, middle, and high voltages, so that a gradual potential change is produced at the main lens section. Optimum lens performance may be obtained if the length of the middle-voltage electrode is substantially equal to the radius of the electrode aperture. However, using this technology, the lens performance cannot be further improved.

For additional improvement in the lens performance, therefore, the multi-element bipotential lens disclosed in U.S. Pat. No. 3,932,786 has been proposed. In an electron gun using this lens, however, resistors arranged near the individual electrodes are small. Thus, the electron gun of this type is unfit for practical use. Moreover, since the voltages of the electrodes are picked up at narrower intervals from the small resistor, the construction and manufacture of the electron gun are complicated. The small gaps between the electrodes facilitate the flow of leakage current between the electrodes. In consequence, undesired current is produced by the leakage current, beam impact hit on the electrodes and other factors, resulting in a change of electrode potential and lowering the lens performance. These drawbacks make it very hard to put an electron gun of this type into practical use.

To increase the diameter of the electron lens, moreover, electron guns of the following types are conventionally proposed. In an electron gun assembly for a color picture tube disclosed in Japanese Patent Application Disclosure No. 124933/80, three electron lenses are formed overlapping one another. In another electron gun stated in the Proceedings of the Third International Display Research Conference, Japan display 1983, pp. 268 through 271, apertures of electrodes are conical. In an electron gun assembly disclosed in Japanese Patent Application Disclosure No. 103246/82, moreover, projections are formed around three apertures. In these electron guns, the diameter of each electron lens is increased, so that the lens performance is improved in some measure. For further improved lens performance, the separation distance of the electrodes need be increased. This separation distance cannot, however, be increased, since it is influenced by undesired electrostatic fields in the neck.

SUMMARY OF THE INVENTION

The object of the present invention is to provide an electron gun for a cathode-ray tube, in which the performance of an electron lens, especially that of the main lens section, is improved, and in which the distortion of an electron beam converged on a target is removed for higher practicality of the electron gun by correcting the influence of the undesired potential on the electron lens.

According to the present invention, there is provided an electron gun for producing and directing at least one electron beam along a beam path, which comprises beam forming means and a main lens for focusing the electron beam. The main lens includes first and second electrodes arranged along the beam path, respectively having opposite surfaces facing each other, and an auxiliary electrode located between the first and second electrodes. The opposite surfaces of the first and second electrodes are each provided with an aperture through which the electron beam passes. The auxiliary electrode also has an aperture through which the electron beam passes. The aperture of the auxiliary electrode is wider than those of the first and second electrodes. The electron gun further comprises means for applying first, second and auxiliary voltages to the first, second and auxiliary electrodes, the first and second voltages being at different levels such that an electrostatic field is formed between the first and second electrodes. The auxiliary voltage is higher than the lower one of the first and second voltages and lower than the higher one. The electron gun further comprises correcting means for correcting the electrostatic field formed between the first and second electrodes and is under the influence of the auxiliary voltage of the auxiliary electrode.

With this arrangement, a long focal lens equivalent to one which may be obtained by increasing the distance between the first and second electrode is formed between the first and second electrodes. The auxiliary electrode serves to prevent the electrostatic field between the first and second electrodes from being influenced by undesired electrostatic fields outside the auxiliary electrode.

According to the present invention, moreover, the arrangement of the correcting means in the auxiliary electrode permits proper correction of the influence of the auxiliary voltage of the auxiliary electrode on the electrostatic field between the first and second electrodes, thereby removing the distortion of the spot of the electron beam produced by the beam forming means which is focused on a target by the main lens means. Thus, the electron gun according to the invention is highly practical.

DETAILED DESCRIPTION OF THE PREFERRED EMBODIMENTS

Figure 1:
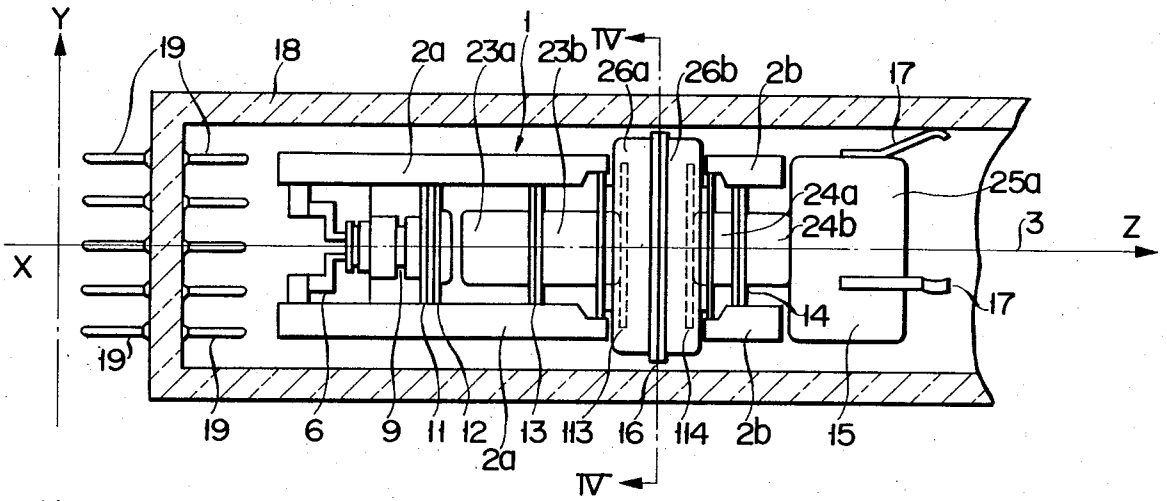
FIG. 1 is a schematic side view, partially in section, of an electron gun assembly according to one embodiment of the present invention applied to a color picture tube, showing the electron gun assembly along its tube axis.
Figure 2:
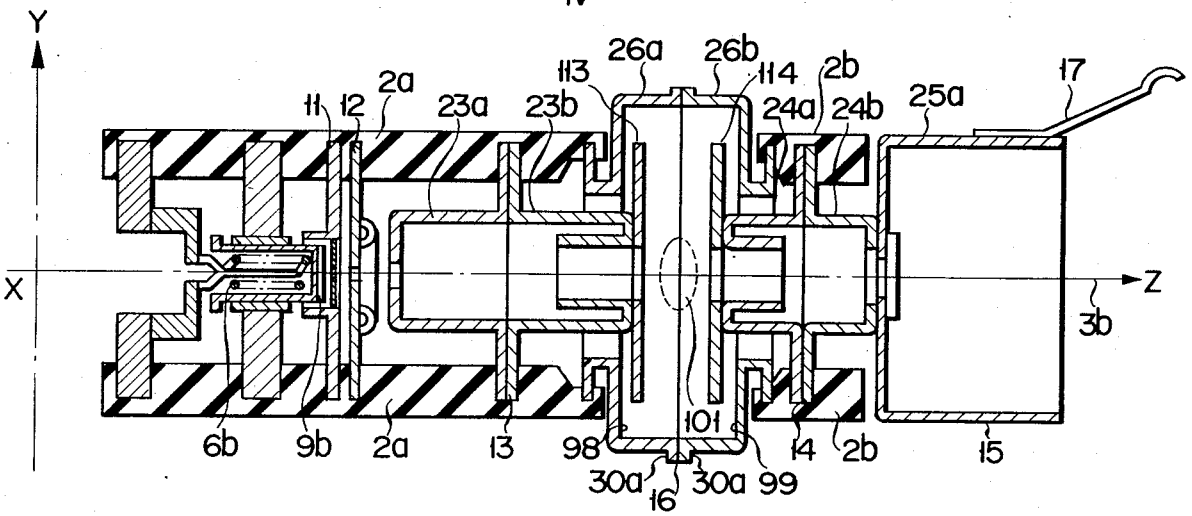
FIG. 2 is a schematic sectional view of the principal part of the electron gun assembly of FIG. 1 taken along a plane perpendicular to a plane containing the tube axis and three electron beams.
Figure 3:
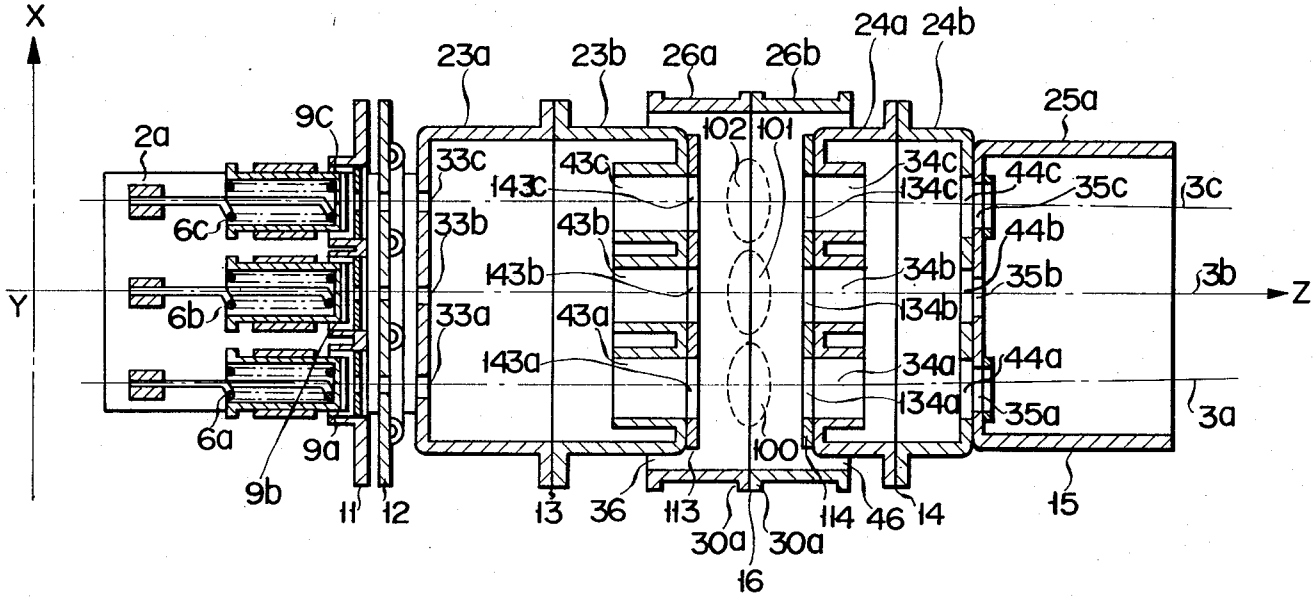
FIG. 3 is a schematic sectional view of the principal part of the electron gun assembly of FIG. 1 taken along the plane containing the tube axis and the three electron guns.

An electron gun according to one embodiment of the present invention applied to a color picture tube will now be described in detail. Referring to FIGS. 1, 2 and 3, there is shown an in-line electron gun assembly 1. In these drawings, direction X is a direction parallel to the in-line direction of the electron gun assembly 1, direction Y is a direction perpendicular to both direction X and the tube axis, and direction Z is a direction in which the tube axis extends and which is perpendicular to both directions X and Y. FIG. 2 is a sectional view of the electron gun 1 taken along a plane containing directions Y and Z, and FIG. 3 is a sectional view of the electron gun 1 taken along a plane containing directions X and Z.

As shown in FIGS. 1, 2 and 3, the electron gun assembly 1 comprises a plurality of electrodes and two pairs of insulating support members 2*a* and 2*b* for supporting the electrodes. The electrodes include cathodes 9*a*, 9*b* and 9*c* arranged in line, first, second, third and fourth grids 11, 12, 13 and 14, a convergence electrode 15, and an auxiliary electrode 16 disposed between the third and fourth grids 13 and 14 and greater in size than the same. Three heaters 6*a*, 6*b* and 6*c* for generating three electron beams 3*a*, 3*b* and 3*c* are arranged in the cathodes 9*a*, 9*b* and 9*c*, respectively. The three electron beams 3*a*, 3*b* and 3*c* generated by the heaters 6*a*, 6*b* and 6*c* in the cathodes 9*a*, 9*b* and 9*c* are passed through the electrodes 11, 12, 13, 16, 14 and 15, respectively, and caused to hit against the red, green and blue phosphor layers (not shown) of a fluorescent screen as a target. The grids 11 to 14 and the convergence electrode 15 have apertures for passing through the electron beams as mentioned later and are unitized.

The electron gun assembly 1 is formed of two fundamental sections: a crossover spot forming section, which includes a beam forming region, consisting of the cathodes 9 and the first and second grids 11 and 12, and an accelerating and focusing lens section for focusing the electron beams on the screen. The crossover spot forming section may also be referred to as a four-pole section, which consists of the cathodes 9 and the first, second, and third grids 11, 12 and 13. The accelerating and focusing lens section is formally referred to as a main lens section, which consists of the third and fourth grids 13 and 14. Thus, the third grid 13 is used in common in the four-pole section and the main lens section.

The construction of these electrodes will now be described in detail. The first and second grids 11 and 12 are planar in shape and arranged in close vicinity to each other. The third grid 13, which is located close to the second grid 12, is formed of two bathtub-shaped electrodes 23*a* and 23*b* which are joined together. The fourth grid 14, which is located at a predetermined distance from the third grid 13, is also formed of two bathtub-shaped electrodes 24*a* and 24*b* which are joined together. The convergence electrode 15 is formed of a single cup-shaped electrode 25*a* which is welded to the fourth grid 14. Three circular aperture are formed in each of the planar first and second grids 11 and 12 and the bottom face portions of both of the bathtub-shaped electrodes 23*a*, 23*b*, 24*a* and 24*b* of the third and fourth grids 13 and 14 and the cup-shaped electrode 25*a* of the convergence electrode 15. Each set of three apertures are aligned with their adjoining counterparts so as to be arranged along the paths of the individual electron beams.

The apertures of the first and second grids 11 and 12 are relatively narrow, and the apertures 33*a*, 33*b* and 33*c* of the third grid 13 on the side facing the second grid 12 are greater than those of the first and second grids 11 and 12. The apertures 43*a*, 43*b* and 43*c* of the third grid 13 on the side facing the fourth grid 14, which are relatively wide, are equal in diameter to the apertures 34*a*, 34*b* and 34*c* of the fourth grid 14 on the side facing the third grid 13. The apertures 35*a*, 35*b* and 35*c* of the convergence electrode 15 are narrower than the 43*a*, 43*b* and 43*c* of the third grid 13 and the apertures 34*a*, 34*b* and 34*c* of the fourth grid 14.

The auxiliary electrode 16 is formed of two bathtub-shaped electrodes 26*a* and 26*b*, and oval shaped apertures 36 and 46 are formed on the bottom faces of the bathtub-shaped electrodes 26*a* and 26*b*, respectively. The bathtub-shaped electrode 23*b* of the third grid 13 and the bathtub-shaped electrode 24*a* of the fourth grid 14 project into the apertures 36 and 46, respectively. As shown in FIG. 2, the bathtub-shaped electrodes 26*a* and 26*b* respectively have a pair of inside walls 98 and 99 respectively extending along the direction Y from the peripheral walls of the bathtub-shaped electrodes 26*a* and 26*b* toward the beam plane.

Control elements are provided individually beside the apertures 44*a* and 44*b* of the convergence electrode 15. The control elements are intended for satisfactory convergence of the three beams 3*a*, 3*b* and 3*c* on any portion of the surface of the screen.

As shown in FIG. 1, a bulb spacer 17 is attached to the outer periphery of the convergence electrode 15. The bulb spacer 17 is supplied with a voltage as high as about 25 kV which is applied to an anode terminal (not shown). The electron gun assembly 1 constructed in this manner is sealed in a small cylindrical neck portion 18 which is formed of glass. A number of stem pins 19 are arranged at the left end portion (FIG. 1) of the neck portion 18. The stem pins 19 support the electron gun 1, and voltages for the grid electrodes 11, 12 and 13 (but not the convergence electrode 15 and the fourth grid 14) are externally applied through the stem pins 19.

In the electrode arrangement as aforesaid, the heaters 6*a*, 6*b* and 6*c*, the first, second and third grids 11, 12 and 13, and the one bathtub-shaped electrode 26*a* of the auxiliary electrode 16 are supported by the one parallel pair of insulating support means 2*a*. The other bathtub-shaped electrode 26*b* of the auxiliary electrode 16 and the fourth grid 14 are supported by the other pair of insulating support means 2*b*. The two bathtub-shaped electrodes 26*a* and 26*b* of the auxiliary electrode 16 are fixed at their flange portions 30*a* and 30*b* by welding. Thus, the electron gun 1 is formed complete.

In the electron gun assembly 1 with the construction described above, for example, the electrodes are supplied with voltages as follows. A cut-off voltage of about 150 V is applied to the cathodes 9, and a modulation signal is added to the cut-off voltage. The first grid 11 is grounded, while voltages of about 700 V and 6.5 kV are applied to the second and third grids 12 and 13, respectively. Further, a high anode voltage of about 25 kV is applied to the fourth grid 14, and a voltage intermediate between those applied to the third and fourth grids 13 and 14 is applied to the auxiliary electrode 16.

In the above described electron gun assembly 1, the facing apertures 43*a*, 43*b*, 43*c*, 34*a*, 34*b* and 34*c* of the third and fourth grids 13 and 14 are made as wide as possible with the electron gun intervals kept narrow. Further, electron lenses 100, 101 and 102 shown in FIGS. 2 and 3 by broken dot lines are formed as long focal lenses which, under the influence of the potential of the auxiliary electrode 16, produce an effect equivalent to that obtained when the distance between the third and fourth grids 13 and 14 is extended. A main lens section formed between the third and fourth grids 13 and 14 is protected against the influences of undesired electric fields in the neck 18 by the auxiliary electrode 16.

In the electron gun assembly 1 described above, however, the potential of the auxiliary electrode 16 may sometimes affect the electron lenses 100, 101 and 102 unless the distance between the third and fourth grids 13 and 14 is shorter than the length of the auxiliary electrode 16 in the direction Z. Therefore, the spots of the three electron beams converged on the target through the electron lenses 100, 101 and 102 may possibly be distorted in shape. In particular, the central electron lens 101 formed between the apertures 43*b* and 34*b* of the third and fourth grids 13 and 14 may be greatly influenced by the inside walls 98 and 99 of the auxiliary electrode 16. It is difficult, moreover, to provide equivalent lens conditions for the central electron lens 101 and the two other electron lenses 100 and 102 formed between the apertures 43*a* and 43*c* of the third grid 13 and the apertures 34*a* and 34*c* of the fourth grid 14.

Considering these circumstances, the inventor hereof made an additional improvement in the electron gun assembly 1. Namely, the electron gun assembly 1 has the following electrode arrangement in its main lens section. As indicated by the broken line in FIG. 2, as well as in FIGS. 2 and 3, platelike electrostatic field correcting electrodes 113 and 114 (hereinafter referred to as correcting electrodes) are welded to the opposite surfaces of the third and fourth grids 13 and 14, respectively. The correcting electrodes 113 and 114 serve to correct the influence of the potential of the auxiliary electrode 16 on the main lens section. Like the bathtub-shaped electrodes 23*b* and 24*a* of the third and fourth grids 13 and 14, the correcting electrode 113 has three beam passage apertures 143*a*, 143*b* and 143*c*, and the correcting electrode 114 has apertures 134*a*, 134*b* and 134*c*. However, the correcting electrodes 113 and 114 greatly differ in shape from the bathtub-shaped electrodes 23*b* and 24*a*. Namely, they are shaped so that the influence of the potential on the main lens section formed between the third and fourth grids 13 and 14 is controlled.

Figure 4:
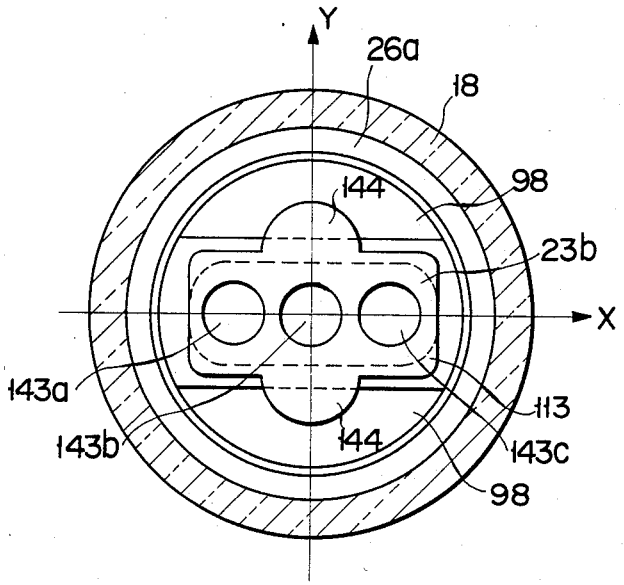
FIG. 4 is an enlarged sectional view of the electron gun assembly taken along line IV—IV of FIG. 1.

FIG. 4 is a sectional view taken along line IV—IV of FIG. 1, showing the one bathtub-shaped electrode 26*a* of the auxiliary electrode 16 and the correcting electrode 113. As shown in FIGS. 2 to 4, the correcting electrode 113 is disposed within the bathtub-shaped electrode 26*a*. In FIG. 4, an outline of the bathtub-shaped electrode 23*b* is indicated by a broken line. The correcting electrode 113 is attached to that portion of the bottom surface of the bathtub-shaped electrode 23*b* which faces the bathtub-shaped electrode 24*a*. As shown in FIG. 4, the X-direction dimension of the correcting electrode 113 is substantially equal to the bathtub-shaped electrode 23*b*, but the Y-direction dimension of the correcting electrode 113 is greater than that of the bathtub-shaped electrode 23*b*. The correcting electrode 113 has a projection 144 projecting over a substantial distance in the direction Y from its central portion. The correcting electrode 114 mounted on the fourth grid 14 is similar to the correcting electrode 13 shown in FIG. 4 in shape.

The correcting electrode 113 mounted on the third grid 13 is applied with the same voltage as the one applied to the third grid 13, and the correcting electrode 114 on the fourth grid 14 with the same voltage as the one applied to the fourth grid 14.

According to the present invention, the attachment of the correcting electrodes 113 and 114 to the third and fourth grids 13 and 14 causes the central electron lens 101 to be hardly influenced by the electrostatic field of the auxiliary electrode 16, especially that of the walls 98 and 99 of the auxiliary electrode 16. Thus, the electron beam 3*b* passed through the central electron lens 101 forms a circular beam spot on the target after undergoing a lens action. On the other hand, the two other electron lenses 100 and 102 are moderately influenced by the potential of the auxiliary electrode 16 in electrostatic fields. The electron beams 3*a* and 3*c* passed through the electron lenses 100 and 102 are converged so as to be bent toward the central electron beam 3*b*. Then, the electron beams 3*a* and 3*c* form a substantially circular beam spot on the target. The three electron beams 3*a*, 3*b* and 3*c* converge on a common spot on the target.

Figures 5A, 5B, 5C:
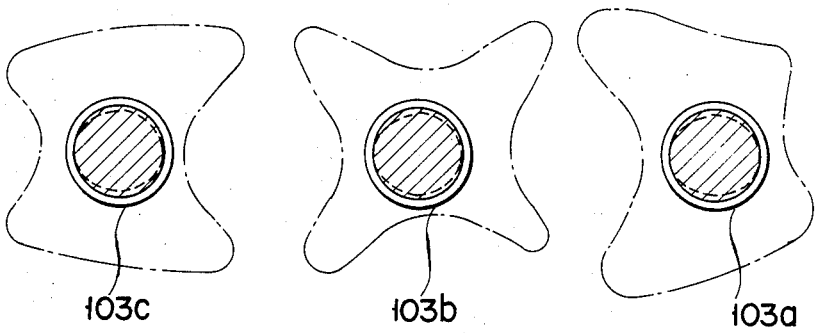
FIGS. 5A, 5B and 5C are schematic views for illustrating the shapes of beam spots on the target, FIGS. 5A and 5C respectively showing the shapes of the beam spots produced by side electron beams in FIG. 3, FIG. 5B showing the shape of the beam spot produced by a center electron beam in FIG. 3, and outlines of halo portions of the beam spots obtained without the use of correcting electrodes in the electron gun assembly respectively being indicated by dashed lines for comparisons.

FIGS. 5A, 5B and 5C respectively show the shape of the spots of the electron beams 3*a*, 3*b* and 3*c*. As shown in FIGS. 5A, 5B and 5C, each of the three beam spots 103*a*, 103*b* and 103*c* includes a substantially circular bright point (hatched portion) and a substantially circular halo portion (outline by full line) without any substantial distortion. For comparison, the bright point and halo portion of each beam spot obtained without the use of the correcting electrodes 113 and 114 in the electron gun 1 are indicated by a broken line and a dashed line, respectively.

In this embodiment, if the length of the auxiliary electrode 16 in the direction Z is not sufficiently longer than the distance between the third and fourth grids 13 and 14, that is, if the inside walls 98 and 99 of the auxiliary electrode 16 are located close to the facing bottom ends of the third and fourth grids 13 and 14, then the influence of the potential of the auxiliary electrode 16 on the electron lenses 100, 101 and 102 is controlled for proper correction by the correcting electrodes 113 and 114. As a result, the distortions of the electron beams 3*a*, 3*b* and 3*c* converged on the target are removed.

Figure 6:
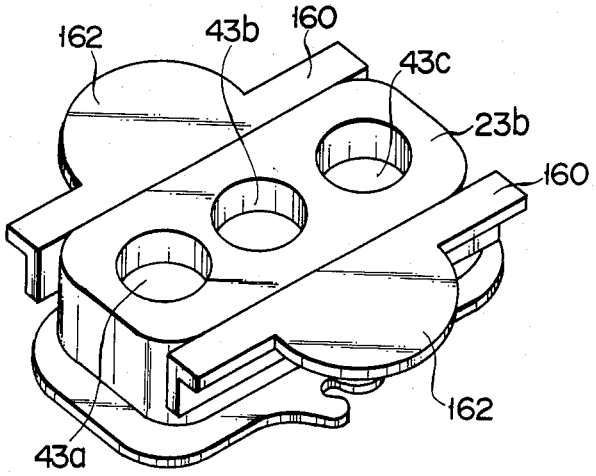
FIG. 6 is a schematic perspective view showing a modified example of the correcting electrode of FIG. 1 mounted on a bathtub-shaped electrode of a third grid.

In the embodiment described above, the correcting electrodes 113 and 114 are mounted as platelike electrodes on the opposite surfaces of the bathtub-shaped electrodes 23*b* and 24*a* of the third and fourth grids 13 and 14, respectively. Alternatively, according to the present invention, correcting electrodes 160 may be attached respectively to the outer surfaces of the longitudinal side walls of the bathtub-shaped electrode 23*b*, as shown in FIG. 6. Each of the correcting electrodes 160 has an L-shaped cross section in the direction Z, including a projection 162 which extends along the opposite surface of the bathtub-shaped electrode 23*b* of the third grid 13 in the vicinity of the central aperture 43*b* thereof.

Figure 7:
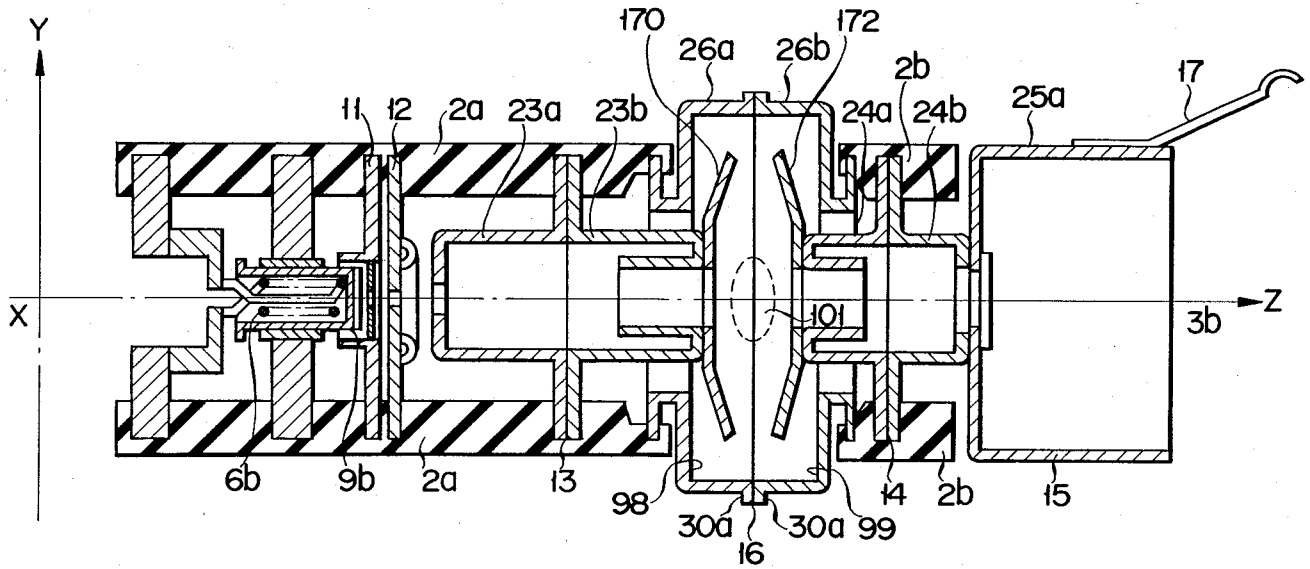
FIG. 7 is a schematic sectional view, similar to FIG. 2, showing an electron gun according to another embodiment of the invention incorporating further modified correcting electrodes.

In the above described embodiment, the correcting electrodes 113 and 114 are each in the form of a flat plate. Alternatively, however, correcting electrodes 170 and 172, whose cross section in the direction, Y is curved along the direction Y, may be provided. Namely, as shown in FIG. 7, both ends of the one correcting electrode 170 in the direction Y extend from its junction with the third grid 13 toward the other correcting electrode 172, and those of the other correcting electrode 172 extend from its junction with the fourth grid 14 toward the one correcting electrode 170.

The shape of the correcting electrodes 170 and 172 is especially effective if the distance in the direction Y between the walls 98 or 99 of the auxiliary electrode 16 and the opposite end of the outer peripheral wall of the bathtub-shaped electrodes 23*b* or 24*a* is short.

In the embodiments shown in FIGS. 1 to 4 and 7, the two correcting electrodes 113 and 114 (170 and 172) are mounted on the longitudinal side walls of the third and fourth grids 13 and 14, respectively. Alternatively, however, a single correcting electrode may be provided on the third or fourth grid 13 or 14, depending on the relative positions of the auxiliary electrode 16 and the third and fourth grids 13 and 14.

Figure 8:
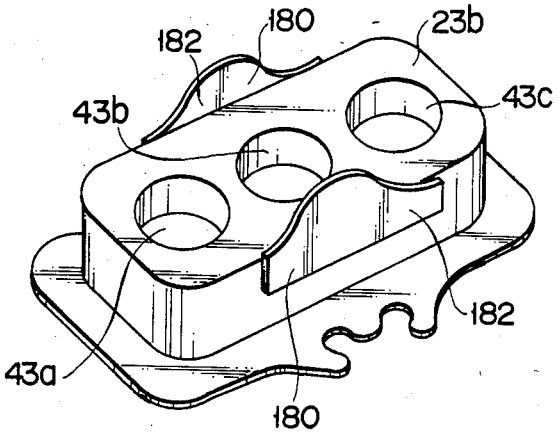
FIG. 8 is a schematic perspective view showing another modified example of the correcting electrodes of FIG. 1 mounted on the bathtub-shaped electrode of the third grid.

According to the present invention, moreover, a pair of correcting electrodes 180, as shown in FIG. 8, may be attached individually to the outer surfaces of the side walls of the bathtub-shaped electrode 23*b* in the same manner as in the case of the correcting electrodes 160 shown in FIG. 6. Each of the correcting electrodes 180 includes a projection 182 which extends along the direction Z in the vicinity of the central aperture 43*b*. The projections 182 of the correcting electrodes 180 make it possible to correct the influence of the electrostatic field of the auxiliary electrode 16, as in the cases of the foregoing embodiments.

According to the present invention, moreover, each of the correcting electrodes may be formed integrally with the third or fourth electrode.

In all the embodiments described above, the arrangement of the electron lenses is based on a bipotential lens which consists of the third and fourth electrodes 13 and 14. The present invention is not, however, limited to such an arrangement, and may also be applied to electron lenses of various other types, such as unipotential, quadra-potential, periodic-potential, and tri-potential electron lenses. Further, a resistor may be provided in the vicinity of the electron gun in the neck portion of the cathode ray so that the high voltage of the fourth grid 14 is divided by the resistor, whereby the third grid 13 and the auxiliary electrode 16 are supplied with voltages.

In the electron gun assembly of the embodiments described above, furthermore, three electron guns are arranged transversely in line. Alternatively, however, the three electron guns may be arranged in a delta, or more electron guns may be arranged in some configuration. The present invention may also be applied to a cathode-ray tube including a single electron gun.

What is claimed is:

1. An electron gun for producing and directing at least one electron beam along a beam path, said electron gun comprising:

beam forming means for generating a plurality of electron beams, the beam paths of the electron beams being within the same beam plane;

main lens means for focusing the electron beams, the main lens means including first and second electrodes arranged along the beam paths and respectively having opposite surfaces facing each other, each electrode having apertures through which the electron beams pass, respectively, the number of apertures being the same as the number of electron beams, and an auxiliary electrode located between the first and second electrodes and having an aperture through which all the electron beams pass, the aperture of the auxiliary electrode having a size such that the opposite surfaces of the first and second electrodes can be located within the aperture;

voltage applying means for respectively applying first, second and auxiliary voltages to the first, second and auxiliary electrodes, the first and second voltages being of different levels, thereby forming an electrostatic field between the first and second electrodes, wherein the auxiliary voltage is higher than the lower one of the first and second voltages and lower than the higher one; and correcting means for correcting the electrostatic field formed between the first and second electrodes, said correcting means including a correcting electrode disposed close to the opposite surface of at least one of the first and second electrodes, wherein said correcting means receives the same voltage as the voltage applied to said one electrode.

2. An electron gun according to claim 1, wherein said correcting means includes a platelike electrode mounted on the opposite surface of at least one of the first and second electrodes, said platelike electrode including a pair of projections projecting toward an inner wall of the aperture of the auxiliary electrode, in a direction perpendicular to the beam plane and including apertures which correspond in shape to the apertures of the one of the first and second electrodes and through which the electron beams pass, respectively.

3. An electron gun according to claim 8, wherein each projection of said platelike electrode is bent so that the peripheral edge portion thereof extends toward the other of the first and second electrodes.

4. An electron gun according to claim 1, wherein each of said first and second electrodes has a peripheral wall continuous with the opposite surface thereof and extending along the beam path, and wherein said correcting means includes a pair of brim-shaped correcting electrodes attached to the peripheral wall of at least one of the first and second electrodes extending along the beam plane near the opposite surface of the one of the first and second electrodes, each said brim-shaped electrode extending from the peripheral wall of the one of the first and second electrodes toward the auxiliary electrode so as to be flush with the opposite surface of the one of the first and second electrodes.

5. An electron gun according to claim 1, wherein the correcting electrode of each of said first and second electrodes has a peripheral wall continuous with the opposite surface, thereof and extending along the beam path, and wherein said correcting means includes a pair of platelike electrodes attached to the peripheral wall of at least one of the first and second electrodes extending along the beam plane near the opposite surface of the one of the first and second electrodes, each said platelike electrode extending from the peripheral wall of the one of the first and second electrodes toward the other of the first and second electrodes.

* * * * *